US009339915B2

(12) United States Patent
Weaver

(10) Patent No.: US 9,339,915 B2
(45) Date of Patent: May 17, 2016

(54) POLYCRYSTALLINE DIAMOND ELEMENT WITH UNLEACHED SIDE SURFACE AND SYSTEM AND METHOD OF CONTROLLING LEACHING AT THE SIDE SURFACE OF A POLYCRYSTALLINE DIAMOND ELEMENT

(75) Inventor: Gary E. Weaver, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1036 days.

(21) Appl. No.: 13/461,552

(22) Filed: May 1, 2012

(65) Prior Publication Data

US 2013/0292184 A1 Nov. 7, 2013

(51) Int. Cl.

| | |
|---|---|
| ***E21B 10/46*** | (2006.01) |
| ***B24D 99/00*** | (2010.01) |
| ***E21B 10/573*** | (2006.01) |

(52) U.S. Cl.

CPC ..... *B24D 99/005* (2013.01); *E21B 10/5735* (2013.01)

(58) Field of Classification Search

USPC ..... 175/425, 434, 420.2

See application file for complete search history.

(56) References Cited

U.S. PATENT DOCUMENTS

| | | | | |
|---|---|---|---|---|
| 4,224,380 | A | 9/1980 | Bovenkerk et al. | 428/545 |
| 5,605,198 | A * | 2/1997 | Tibbitts et al. | 175/432 |
| 6,398,815 | B1 * | 6/2002 | Pope et al. | 623/23.6 |
| 7,517,589 | B2 | 4/2009 | Eyre | 428/408 |
| 7,608,333 | B2 | 10/2009 | Eyre | 428/408 |
| 7,712,553 | B2 | 5/2010 | Shamburger | 175/374 |
| 2006/0060390 | A1 * | 3/2006 | Eyre | 175/432 |
| 2006/0162969 | A1 * | 7/2006 | Belnap et al. | 175/433 |
| 2008/0223623 | A1 * | 9/2008 | Keshavan et al. | 175/434 |

* cited by examiner

*Primary Examiner* — Willam P Neuder
*Assistant Examiner* — Ronald Runyan
(74) *Attorney, Agent, or Firm* — Baker Botts L.L.P.

(57) ABSTRACT

The disclosure provides a PCD element containing a substrate and a PCD layer. The PCD has a top surface, a side surface, an intermediate surface, an unleached region containing a diamond body matrix and an interstitial matrix including a catalyst, and a leached region containing a diamond body matrix and empty space in the place of the interstitial matrix. The catalyst has been leached from the empty space in the place of the interstitial matrix. The unleached region is adjacent to a substantial portion of the side surface and the leached region is not adjacent to a substantial portion of the side surface, and the leached region is adjacent to the top surface or the intermediate surface. The disclosure also provides a system and method for leaching a PCD element including a liquid able to leach a catalyst and a protective member.

27 Claims, 3 Drawing Sheets

POLYCRYSTALLINE DIAMOND ELEMENT WITH UNLEACHED SIDE SURFACE AND SYSTEM AND METHOD OF CONTROLLING LEACHING AT THE SIDE SURFACE OF A POLYCRYSTALLINE DIAMOND ELEMENT

TECHNICAL FIELD

Embodiments of the invention relate to polycrystalline diamond (PCD) elements containing a catalyst material that has been selectively leached from a region adjacent to at least a portion of the surface of the PCD element, including at least a portion of the top surface or at least a portion of an intermediate surface, but which has not been substantially leached from a region adjacent to the side surface of the PCD element. Other embodiments of the current invention relate to systems and methods of leaching the catalyst material from the PCD element to achieve leaching of a region adjacent to at least a portion of the top or at least a portion of an intermediate surface, but to substantially protect the region adjacent to the side surface from leaching.

BACKGROUND

Components of various industrial devices are often subjected to extreme conditions, such as high impact contact with abrasive surfaces. For example, such extreme conditions are commonly encountered during subterranean drilling for oil extraction or mining purposes. Device components in these conditions have a longer usable life it they are coated with a layer of diamond to form a polycrystalline diamond (PCD) layer on the component's surface. Diamond is extremely hard, conducts heat away from the point of contact with the abrasive surface, and may provide other benefits to the component. Device components coated in some fashion with polycrystalline diamond are generally referred to as PCD elements. They are sometimes also referred to as PCD compacts.

PCD elements are formed by covering the surface of an substrate with grains of diamond crystal and a catalyst material, then subjecting the covered surface to high temperature and pressure sufficient to cause the diamond grains to fuse into a diamond body matrix in a PCD layer. The catalyst also becomes trapped in the PCD layer in an interstitial matrix. The interstitial matrix is typically continuous within the diamond body matrix.

The catalyst trapped in the PCD layer both provides additional benefits as compared to diamond alone and causes certain detriments. For example, by filling in what would otherwise be empty space in the PCD layer, the catalyst provides structural integrity and makes the PCD layer stronger. For example, the ability of the PCD layer to resist shock loading, sometimes called impact strength, is improved by the presence of the catalyst. One patent, U.S. Pat. No. 4,224,380 to Bovenkerk, reports a decrease in strength of 20% between leached and unleached PCD layers. However, because the catalyst is not as hard as diamond, it reduces the ability of the PCD layer to not be worn down by the surfaces it contact, which is often referred to as abrasion resistance. Similarly, because the catalyst does not conduct heat as well as diamond, it heats up near the point of contact with the abrasive surface much more rapidly than does the diamond. This tendency can cause the catalyst to swell and cause small cracks in the surrounding PCD layer or result in other physical damage. Thus, the catalyst reduces the thermal stability, or ability to withstand degradation due to high temperatures, of the PCD layer.

As a result of these or other effects, it is sometimes advantageous to remove the catalyst from all or part of the PCD layer. The most common process for catalyst removal uses a strong acid bath, although other processes that employ electrolytic and liquid metal techniques exist. When using an acid bath process, two regions of the PCD element are typically protected. First, any non-PCD portions of the element, such as the substrate, are protected. These portions will typically be damaged or may detach from the PCD layer if they are exposed to acid. Second, any PCD portion that will not be leached is protected. Due the ability of leaching to cause both positive and negative effects, the areas of a PCD element leached as well as other effects of the leaching process may be varied to achieve different effects.

Leaching is typically performed in batches, with several PCD elements being leached at once. The leaching process, like most industrial processes, is carefully controlled such that the amount of catalyst removed, the depth from the PCD layer surface to which it is removed, and other effects tend to be very similar from batch to batch. Many properties of a leached PCD element can often only be accurately determined through destructive testing. Accordingly, it is a common practice to evaluate the effects of leaching and the resulting PCD element properties by selecting one or more representative PCD elements from each batch, or periodically as representative of multiple batches, and performing testing on those PCD elements.

Although various types of leached PCD elements exist, many more remain to be developed and evaluated. In particular, PCD elements that balance the benefits and disadvantages of leaching to improve or maximize the usable life of the PCD elements or devices containing them are needed.

SUMMARY

The current invention, in one embodiment, provides a PCD element containing a substrate and a PCD layer. The PCD layer has a top surface, a side surface, an intermediate surface located between the top surface and the side surface, an unleached region containing a diamond body matrix and an interstitial matrix containing a catalyst. The PCD layer also has a leached region containing a diamond body matrix and empty space in the place of the interstitial matrix. In this element, the catalyst has been leached from the empty space in the place of the interstitial matrix. The unleached region is adjacent to a substantial portion of the side surface and the leached region is not adjacent to a substantial portion of the side surface. The leached region is adjacent to at least a portion of the top surface or at least a portion of the intermediate surface.

In one embodiment, the current invention relates to a subterranean drill bit containing a PCD element as described above.

The current invention, according to another embodiment, provides a system for leaching a PCD element including a liquid containment vessel containing a liquid able to leach a catalyst from a PCD element without disrupting the diamond body matrix in the PCD element; and a protective member disposed on a side surface of the PCD element but not on at least a portion of a top surface or an intermediate surface of the PCD element.

The current invention, according to a third embodiment, includes a method of selectively leaching a PCD element by covering a substantial portion of a side surface of a PCD element with a protective member while leaving at least a portion of a top surface or an intermediate surface of the PCD element uncovered, then leaching a catalyst from a leached region adjacent to at least a portion of the top surface or intermediate surface of the PCD element using a liquid able to leach the catalyst from the PCD element without disrupting the diamond body matrix in the PCD element.

BRIEF DESCRIPTION OF THE DRAWINGS

A more complete understanding of the present embodiments and advantages thereof may be acquired by referring to the following description taken in conjunction with the accompanying drawings, in which.

DETAILED DESCRIPTION

The current invention relates to selectively leached PCD elements. According to one embodiment, the PCD elements may be leached in regions adjacent to at least a portion of the top surface or at least a portion of the intermediate surface between the top surface and the side surface, but may remain substantially unleached in regions adjacent to the side surface.

PCD elements with an unleached side surface may have an advantage over similar elements with a leached side surface. Because removal of the catalyst during leaching decreases the strength of the PCD layer, PCD element with an unleached side surface have higher strength on their side surface than if that surface were leached. In particular, PCD elements with an unleached side surface may have greater impact strength on the side surface than if that surface were leached. Overall, the unleached side surface may contribute to the strength, particularly the impact strength, of the PCD layer or the PCD element as a whole. In many uses, such as subterranean drill bits, the side of the PCD element carries all or a substantial portion of the load, such as the drilling load, of the device. Thus, in many uses, compromising the strength of the side of the PCD element by leaching the side may cause serious deleterious effects and may decrease the usable life of the PCD element or a device containing it.

At the same time, leaching the at least a portion of the top surface and at least a portion of the intermediate surface may allow the PCD layer or the PCD element as a whole to obtain benefits of leaching, such as improved abrasion resistance or thermal stability. These benefits may be particularly important at the top surface and intermediate surface as these surfaces are most often in contact or near the point of contact with the abrasive material and thus benefit from improved abrasion resistance or thermal stability more than other surfaces or regions of the PCD element. In many uses, leaching only the top and intermediate surfaces of the PCD element may provide significant beneficial effects and may increase the usable life of the PCD element or a device containing it.

Leaching only the top and intermediate surfaces, but not the side surface may be achieved through selective exposure of only those surfaces to the leaching process. For example, only those surfaces may be exposed to an acid bath. Protecting the side surface from leaching may also offer the advantage of making it easier to protect other PCD element materials, such a substrate, that may be harmed by leaching conditions.

Specific embodiments of the invention are discussed below in relation to the FIGURES, in which like numerals designate like elements.

Figure 1:
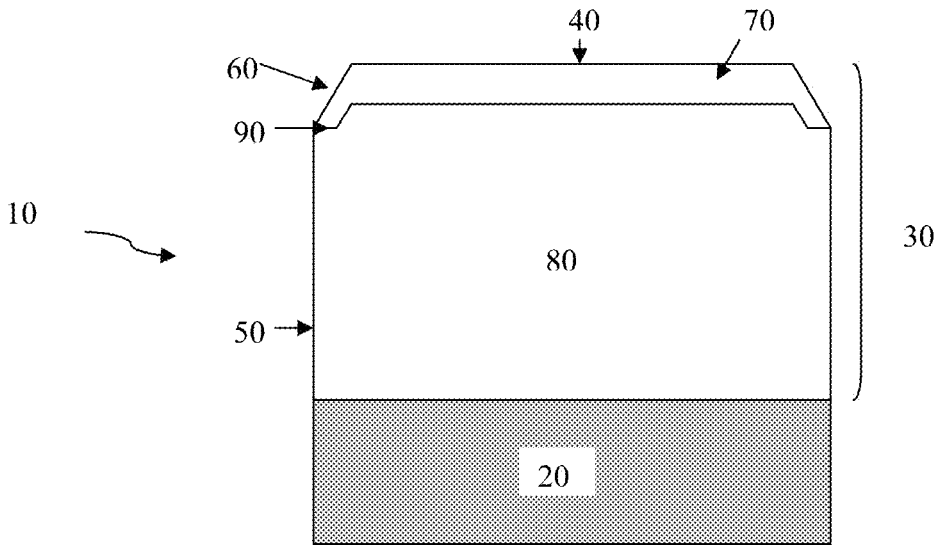
FIG. 1 is a cross-sectional side view of a PCD element having a chamfered intermediate surface, a substantially leached region adjacent to the top surface, a substantially leached region adjacent to the intermediate surface, and a substantially unleached region adjacent to the side surface, according to one embodiment of the present invention.
Figure 2:
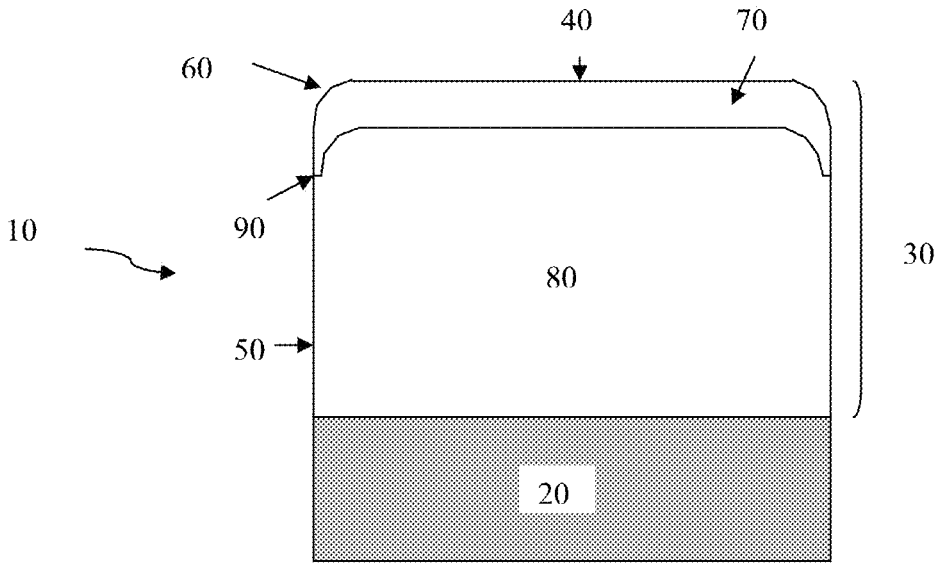
FIG. 2 is a cross-sectional side view of a PCD element having a multiple beveled intermediate surface, a top surface with adjacent leached regions and unleached regions, a substantially leached region adjacent to the intermediate surface and a substantially unleached region adjacent to the side surface, according to one embodiment of the present invention.
Figure 3:
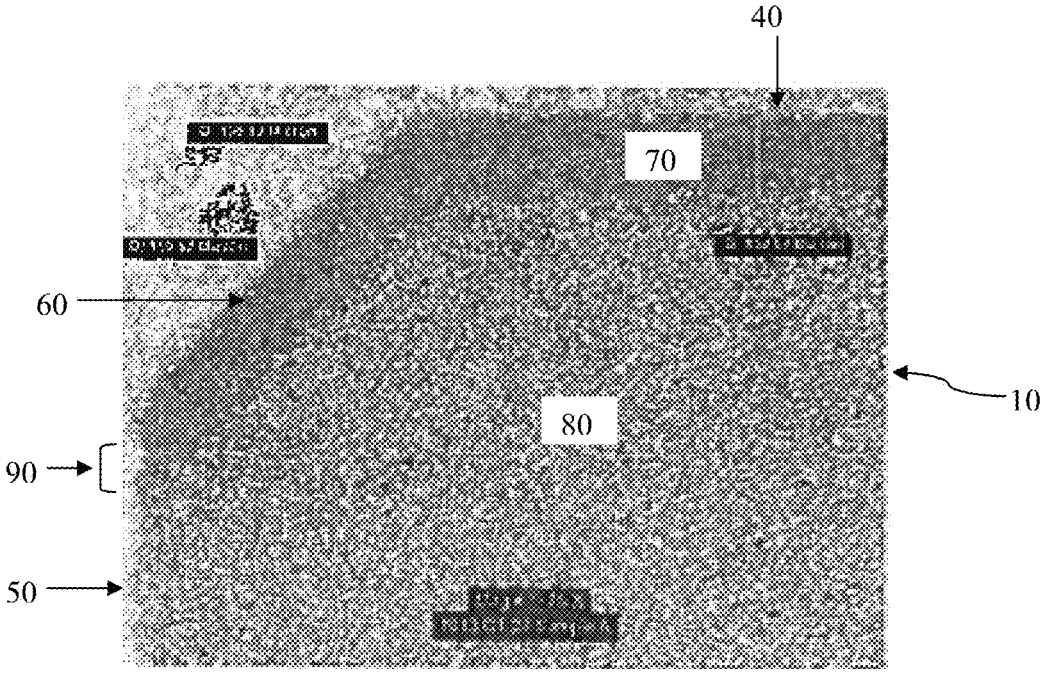
FIG. 3 is a photomicrograph of a cross-sectional side view of a PCD element substantially leached region adjacent to the top and intermediate surfaces, but not the side surface, according to one embodiment of the present invention.

FIGS. 1, 2, and 3 all present a cross-sectional side view of a PCD element, 10. The PCD element, 10 may be any type of device component that has a PCD layer. In specific examples, PCD element, 10, may be an element, such as a cutter, for a subterranean drill bit, including a bits for mining and oil extraction. In particular it may be an element, such as a cutter, for a rotary cone or fixed cutter drill bit. The PCD element may also be an a manufacturing cutting component, such as a tooling or machining cutter. The PCD element may also be a high-wear component or a component designed to operate at high temperature.

PCD element, 10, may include a substrate, 20, upon which the PCD layer, 30, is formed. Substrate, 20, may be any suitable material chosen based on the final intended use of the PCD element, 10. In specific embodiments, it may contain tungsten, for example in the form of tungsten carbide.

PCD layer, 30, may contain a diamond body matrix that may be continuous. The diamond body matrix may be formed from grains of diamond. The diamond grains may have a grain size on the micrometer or nanometer scales. Grain size may be chosen depending on the desired final properties of the PCD element, 10. Finer grain sizes may benefit more from the presence of an unleached side surface than larger grain sizes. Grain size may be substantially uniform in the PCD layer, 30. Alternatively, grain size may vary consistently within the layer or it may be different in different sublayers. For instance, sublayers with have one grain size in the interior and a different grain size in the exterior. PCD layer, 30, may be at least 0.5 microns thick. It may vary in thickness in different regions of the PCD element.

PCD layer, 30, may contain a leached region, 70, and an unleached region, 80. In unleached region, 80, the catalyst may form an interstitial matrix, which may be continuous. The catalyst material may be any material suitable to cause bonding of diamond grains to form the diamond body matrix. In specific embodiments, the catalyst may include one or a mixture of Group VIII elements, particularly cobalt, iron or nickel. The catalyst may also include other elements or compounds, particularly if the catalyst is an alloy. In a specific embodiment, the catalyst may be elemental cobalt or a cobalt alloy.

This interstitial matrix may be all or partially removed in leached region, 70, reflecting total or partial removal of the catalyst. In specific embodiments, an average of at least 80% of the space normally occupied by the interstitial matrix may be empty in the leached region, 70. In more particular embodiments, an average of at least 90%, at least 95%, or at least 99% of the space normally occupied by the interstitial matrix may be empty in the leached region, 70. The amount of catalyst removed and hence the amount of empty space may be chosen depending on the desired properties of the PCD element, 10. In general, less empty space results in improved strength of the leached PCD region, 70, but more empty space results in improved abrasion resistance and thermal stability of the leached PCD region, 70. Although not illustrated here, the amount of empty space within leached PCD region, 70 may not be uniform. For example, due to the need for many leaching materials, such as acid, to seep into the PCD layer, 30, there may be more empty space near the surface of PCD element, 10, than areas of the leached region, 70, further away from the surface. Additionally, the amount of empty space may vary along the surface of leached region, 70, depending on the leaching conditions. For example, the surface of a portion of leached region, 70, may be covered during at least a part of the leaching process to decrease the degree of leaching and hence the amount of empty space in portions of leached region, 70, adjacent to the covered surface.

The leached region may extend an average depth from the adjacent surface. In some embodiments, this average depth may be less than 0.3 mm, 0.2 mm, or 0.1 mm. The depth of leaching may be uniform across the one or more surfaces, or if may vary. The leaching depth and any variation may be chosen depending in the desired properties of PCD element, 10. For example, deeper leaching removes more catalyst and therefore decreases the strength of the PCD element, 10, particularly in the region of the deeper leaching, than does shallower leaching and may be harder and more costly to accomplish. However, shallower leaching may provide lesser abrasion resistance of thermal stability benefits than deeper leaching.

The PCD element, 10, may have a top surface, 40, as side surface, 50, and an intermediate surface, 60, between the top and side surfaces. Although top and side surfaces, 40 and 50, are shown here as substantially flat and perpendicular to one another for ease of explanation, they need not be flat in all embodiments and may also be at skewed angles to one another. In particular embodiments, the top surface, for example, may be generally conical or may have one or more conical regions. Intermediate surface, 60, may be chamfered as shown in FIGS. 1 and 3, beveled as shown in FIG. 2, or it may be a radius (not shown). If beveled, intermediate surface, 60, may include multiple facets to make up the bevel (FIG. 2).

Leached region, 70, may be found adjacent to all of the top surface, 40 and intermediate surface, 60, as shown in FIGS. 1 and 3, or it may be found adjacent to only a portion of top surface, 40 (not shown), or adjacent to only a portion of intermediate surface, 60 (not shown). Leached region 70 may not substantially extend into the area adjacent to the side surface, 50.

A leached region boundary, 90, may exist between the leached region, 70, adjacent to intermediate surface, 60, and the unleached region, 80, adjacent to side surface, 50. According to a specific embodiment, the difference in percentage empty space normally occupied by interstitial matrix may be at least 50% across the boundary (e.g. the empty space may be 80% adjacent to the intermediate surface, 60, and only 30% adjacent to the side surface, 50.) According to more particular embodiments, the difference may be at least 60%, at least 70%, at least 80%, or at least 90%. The boundary 90, in some embodiments may be no more than 0.05 mm thick, no more than 0.03 mm thick, or no more than 0.01 mm thick, measuring from the region adjacent to intermediate surface, 60, with at least 80% empty space in the interstitial matrix, to the region adjacent to side surface, 50, with no more than 30% empty space in the interstitial matrix.

According to one particular embodiment, the portion of the side surface, 50, adjacent to the unleached region, 80, may have a distance of at least 90% of the distance between the substrate, 20, and the edge of intermediate surface, 60, closest to substrate, 20. According to more specific embodiments, the portion of side surface, 50, adjacent to the unleached region, 80, may have a distance of at least 95% or at least 99% of the distance between the substrate, 20, and the edge of intermediate surface, 60, closest to substrate, 20. The portion of the side surface adjacent to the unleached region may constitute the portion of the side surface with no more than 30% empty space in the interstitial matrix adjacent to that portion of the side surface. In more specific embodiments, it may constitute the portion of the side surface with no more than 20% or 10% empty space in the interstitial matrix adjacent to that portion of the side surface.

Figure 4:
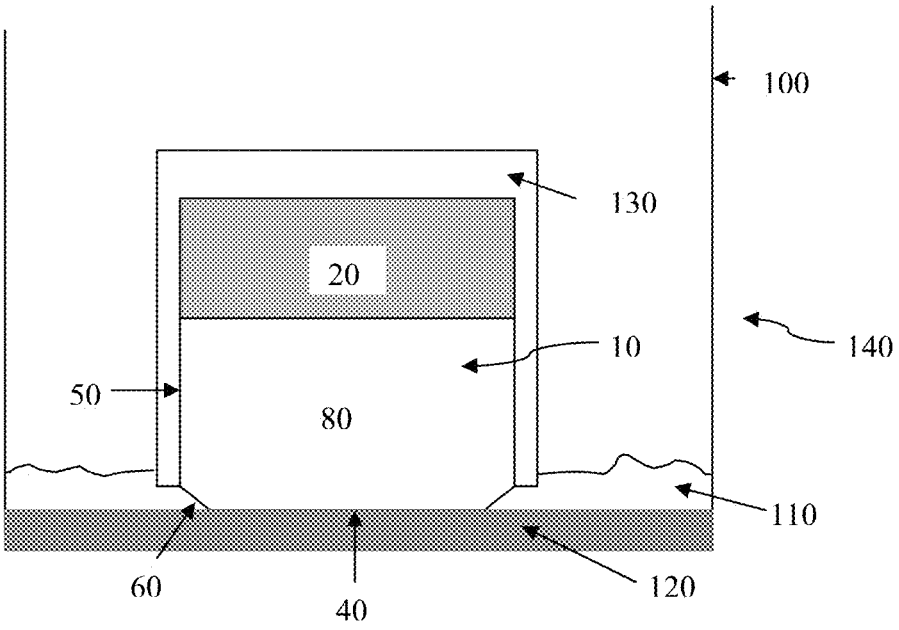
FIG. 4 is a cross-sectional side view of an acid bath containing an unleached PCD element with protective material on its side surface, but not its top or intermediate surfaces, according to one embodiment of the present invention.

FIG. 4 illustrates a cross-sectional side view of one system, 140, for removing catalyst from the regions adjacent to the top and intermediate surfaces, 40 and 60, of a PCD element, 10, but not the side surface, 50. Liquid containment vessel, 100, contains a liquid, 110, able to remove the catalyst from the PCD element, 10, without disrupting the diamond body matrix. According to particular embodiments, liquid 110 may include a strong acid. Suitable acids are disclosed in U.S. Pat. No. 4,224,380 to Bovenkerk, incorporated in material part by reference herein. In particular, suitable acids may include hydrochloric, hydrofluoric acid, or sulfuric acids, or combinations thereof. Liquid containment vessel, 100, may also contain spacer, 120, on which the PCD element, 10, may rest. Spacer, 120, may allow liquid, 110, to reach top surface, 40 and intermediate surface, 60, of PCD element, 10.

Side surface, 50, may be covered by protective member, 130. The remainder of PCD element, 10, including substrate, 20, may also be covered by protective member, 130. Substrate materials, such as tungsten carbide, or the bond between the substrate materials and the PCD layer may be seriously damaged by liquid, 110, particularly if liquid, 110, is an acid, making protection of the substrate desirable in most leaching systems and processes.

Protective member, 130, may take any number of forms. Generally, protective member, 130, may be sufficiently resistant to degradation or damage by liquid, 110, to avoid malfunction of protective member, 130, and exposure of side surface, 50, to liquid, 110, for at least a length of time sufficient for PCD element, 10, to be leached as desired. In one embodiment in which leaching of intermediate surface, 60, near the junction with side surface, 50, is desired, protective member, 130, may be placed close to this junction. Leaching typically will occur along any portion of side surface, 50, not covered by protective member, 130.

Various devices and systems of leaching a PCD element, 10, using a protective member, 130, and a liquid, 110, have been developed and may be adapted for use with the current invention by placing the protective member of such devices and systems close to the junction of side surface, 50, and intermediate surface, 60. For example, an O-ring may be incorporated into the end of protective member, 130, to prevent liquid, 110, from entering protective member, 130. One such example of an O-ring-based protective member may be found in U.S. Pat. No. 7,712,553 of Shamburger, incorporated in material part by reference herein. Another O-ring-based protective member is described in connection with an acid-resistant fixture in U.S. 2006 0060392 of Eyre, incorporated in material part by reference herein. Another system for protecting the a portion of a PCD element from acid by casting a cured epoxy around portions of the PCD element to protect them is described in U.S. Pat. No. 4,224,380 of Bovenkerk, also incorporated in material part by reference herein. This method is known to allow some creeping of acid under the edges of the epoxy and thus may result in some minimal leaching of the region adjacent to side surface, 50, near its junction with intermediate surface, 60. This may result in a larger leached region boundary, 90. The system of Bovenkerk, however, may be more readily adaptable than other methods to protect portions of the top surface, 40, or intermediate surface, 60, resulting in a pattern of leaching as shown in FIG. 2. The system of Bovenkerk may also be more easily used when the amount of leaching of different surfaces is varied because the epoxy may be applied for a period of time when the remainder of the PCD element is being leached, then removed to allow some leaching of the adjacent region.

It will also be understood that, although the above-identified leaching systems and devices may not have previously been used in conjunction with one another, they may be so used in order to produce PCD elements, 10, of the current invention. Other leaching systems and methods not specifically described herein, but able to prevent substantial leaching of the region adjacent to the side surface, 50, may also be used alone or in conjunction with one or more of the above systems or methods.

Although a specific description of systems and methods using a liquid able to leach the catalyst on it own is provided above, such systems and methods may be adapted to electrolysis methods. Also alternative systems and methods that similarly protect the side surface, 50, of PCD element, 10, but not the top surface, 40, or intermediate surface, 60, may be used in electrolytic leaching or liquid metal techniques.

The invention also includes a method of leaching a PCD element such that only the region adjacent to at least a portion of the top surface or at least a portion of the intermediate surface is leached and the region adjacent to the side surface is substantially unleached. The method includes protecting substantially all of the side surface of a PCD element with a protective member while not protecting at least a portion of the top surface or at least a portion of the intermediate surface. The protective member may be of the types described above. Next, the PCD element is placed in a leaching device, such as the types described above, and at least a portion of the catalyst is leached from the unprotected surfaces and adjacent regions. The method by which the catalyst is removed may be acid-based or electrolytic. The leaching method may follow the methods used in of U.S. Pat. No. 7,712,553, U.S. 2006 0060392, or U.S. Pat. No. 4,224,380, incorporated in material part by reference herein, or may use combinations of those methods. It may also use other methods alone or in combination with the methods of those references. After leaching, the PCD element may be removed from the leaching device and the leaching process ended.

In some embodiments, some portions of the top surface or intermediate surface may be protected initially, then after some leaching, the protective member may be removed from those surfaces, then leaching may be resumed, allowing lesser leaching of the regions adjacent to those surfaces.

After leaching is completed, the leached PCD element, 10, may be evaluated to determine its properties. Testing may include cutting the PCD element, 10, cross-sectionally to observe the pattern of leaching, the depth of leaching, and the percentage of empty interstitial matrix, among other properties. Such a cross-sectional view of a cutter is presented in FIG. 3. In the cross-sectional test, one may also observe the degree of leaching, if any, along the side surface and its adjacent regions, measure the portion of the side surface leached, and measure the leached region boundary.

PCD elements, 10, may also be heated to various temperatures then tested for cracking, for example by observing a cross-section, or other evidence of thermal damage to determine thermal stability at different temperatures. Differences in thermal stability at high temperatures may be detectable between the side surface and the top or intermediate surfaces.

PCD elements, 10, may also be subjected to abrasion on the top or intermediate surfaces and side surfaces to determine abrasion resistance. Differences may be detectable between the side surface and the top or intermediate surfaces in this test as well.

PCD elements, 10, may undergo strength tests, such as impact strength testing. Physical breakdown may be visible on the surface of the PCD elements, 10, as a result of this testing or may be detected by cutting the PCD elements, 10, for example cross-sectionally. Differences in strength may be detectable between the side surface and the top or intermediate surfaces in this test.

Other tests may also be performed on the PCD elements, 10. Test results may be visible to the naked eye or may be viewed using microscopy. Some tests may involve chemical analysis. In general, the test results for any PCD element, 10, are high likely to be representative of other PCD elements, 10, produced and leached in a similar fashion. Accordingly, each PCD element, 10, need not be tested to know its properties. Representative PCD elements, 10 may be tested to determine the properties of PCD elements produced in a batch or using the same production and leaching methods.

Although only exemplary embodiments of the invention are specifically described above, it will be appreciated that modifications and variations of these examples are possible without departing from the spirit and intended scope of the invention. For example, in the specification particular measurements are given. It would be understood by one of ordinary skill in the art that in many instances other values similar to, but not exactly the same as the given measurements may be equivalent and may also be encompassed by the present invention.

The invention claimed is:

1. A PCD element comprising:

a substrate; and a PCD layer, the PCD layer comprising:

a top surface, a side surface, an intermediate surface located between the top surface and the side surface, wherein the intermediate surface is chamfered, beveled, or at a radius, an unleached region comprising a diamond body matrix and an interstitial matrix comprising a catalyst;

a leached region comprising a diamond body matrix and empty space in the place of the interstitial matrix from which the catalyst has been leached;

wherein the unleached region is adjacent to a substantial portion of the side surface and the leached region is not adjacent to a substantial portion of the side surface, and wherein the leached region is adjacent to at least a portion of the top surface and the intermediate surface, wherein a portion of the side adjacent to the unleached region has a distance of at least 90% of the distance between the substrate and an edge of the intermediate surface closest to the substrate; and a boundary region between the leached region and the unleached region, wherein the boundary region is no more than 0.05 mm thick and the difference in the percentage empty space in the place of the interstitial matrix is at least 50% across the boundary region.

2. The PCD element according to claim 1, wherein the leached region contains at least 80% empty space in place of the interstitial matrix.

3. The PCD element according to claim 1, wherein the unleached region contains no more than 30% empty space in the place of the interstitial matrix.

4. The PCD element according to claim 1, wherein a portion of the side adjacent to the unleached region has a distance of at least 95% of the distance between the substrate and an edge of the intermediate surface closest to the substrate.

5. The PCD element according to claim 1, wherein the catalyst comprises a Group VIII element.

6. The PCD element according claim 5, wherein the catalyst comprises cobalt.

7. The PCD element according to claim 1, wherein the boundary region is less than 0.03 mm thick.

8. The PCD element according to claim 1, wherein the boundary region is less than 0.01 mm thick.

9. The PCD element according to claim 1, wherein the difference in the percentage empty space in the place of the interstitial matrix is at least 60% across the boundary region.

10. The PCD element according to claim 1, wherein the difference in the percentage empty space in the place of the interstitial matrix is at least 70% across the boundary region.

11. The PCD element according to claim 1, wherein the difference in the percentage empty space in the place of the interstitial matrix is at least 80% across the boundary region.

12. The PCD element according to claim 1, wherein the difference in the percentage empty space in the place of the interstitial matrix is at least 90% across the boundary region.

13. A drill bit comprising:

a bit body; and at least one PCD element affixed to the bit body, the PCD element comprising:

a substrate; and a PCD layer, the PCD layer comprising:

a top surface, a side surface, an intermediate surface located between the top surface and the side surface, wherein the intermediate surface is chamfered, beveled, or at a radius, an unleached region comprising a diamond body matrix and an interstitial matrix comprising a catalyst;

a leached region comprising a diamond body matrix and empty space in the place of the interstitial matrix from which the catalyst has been leached;

wherein the unleached region is adjacent to a substantial portion of the side surface and the leached region is not adjacent to a substantial portion of the side surface, and wherein the leached region is adjacent to at least a portion of the top surface and the intermediate surface, wherein a portion of the side adjacent to the unleached region has a distance of at least 90% of the distance between the substrate and an edge of the intermediate surface closest to the substrate; and a boundary region between the leached region and the unleached region, wherein the boundary region is no more than 0.05 mm thick and the difference in the percentage empty space in the place of the interstitial matrix is at least 50% across the boundary region.

14. The drill bit according to claim 13, wherein the drill bit comprises a fixed cutter drill bit.

15. The drill bit according to claim 13, wherein the drill bit comprises a rotary cone drill bit.

16. The drill bit according to claim 13, wherein at least one PCD element comprises a cutter.

17. The drill bit according to claim 13, wherein the leached region contains at least 80% empty space in place of the interstitial matrix.

18. The drill bit according to claim 13, wherein the unleached region contains no more than 30% empty space in the place of the interstitial matrix.

19. The drill bit according to claim 13, wherein a portion of the side adjacent to the unleached region has a distance of at least 95% of the distance between the substrate and an edge of the intermediate surface closest to the substrate.

20. The drill bit according to claim 13, wherein the catalyst comprises a Group VIII element.

21. The drill bit according to claim 13, wherein the catalyst comprises cobalt.

22. The drill bit according to claim 13, wherein the boundary region is less than 0.03 mm thick.

23. The drill bit according to claim 13, wherein the boundary region is less than 0.01 mm thick.

24. The drill bit according to claim 13, wherein the difference in the percentage empty space in the place of the interstitial matrix is at least 60% across the boundary region.

25. The drill bit according to claim 13, wherein the difference in the percentage empty space in the place of the interstitial matrix is at least 70% across the boundary region.

26. The drill bit according to claim 13, wherein the difference in the percentage empty space in the place of the interstitial matrix is at least 80% across the boundary region.

27. The drill bit according to claim 13, wherein the difference in the percentage empty space in the place of the interstitial matrix is at least 90% across the boundary region.

* * * * *